US006797133B2

(12) United States Patent
Smith et al.

(10) Patent No.: US 6,797,133 B2
(45) Date of Patent: Sep. 28, 2004

(54) MOBILE ZINC CATHODE STRIPPING SYSTEM

(75) Inventors: Barry John Smith, Burlington (CA); Leopoldo Escobedo Asensio, Asturia (ES); Jan Bosscher, Burlington (CA)

(73) Assignee: Outokumpu Technology Ltd., Burlington (CA)

( * ) Notice: Subject to any disclaimer, the term of this patent is extended or adjusted under 35 U.S.C. 154(b) by 296 days.

(21) Appl. No.: 09/870,114

(22) Filed: May 30, 2001

(65) Prior Publication Data

US 2002/0179431 A1 Dec. 5, 2002

(51) Int. Cl.[7] ..... C25D 17/00; C25D 1/00
(52) U.S. Cl. ..... 204/227; 204/281
(58) Field of Search ..... 204/226, 227, 204/286.1, 281, 208

(56) References Cited

U.S. PATENT DOCUMENTS 3,840,032 A * 10/1974 Sitges ..... 204/281 X
3,935,091 A * 1/1976 Rautimo et al. ..... 204/281
4,131,531 A * 12/1978 Kaneko et al. ..... 204/208
4,209,379 A * 6/1980 Freeman et al. ..... 204/198
5,269,897 A 12/1993 Menendez et al. ..... 204/226

FOREIGN PATENT DOCUMENTS

AU 506 151 B 1/1979
CA 2178776 12/1997

* cited by examiner

*Primary Examiner*—Donald R. Valentine
(74) *Attorney, Agent, or Firm*—Vidas, Arrett & Steinkraus

(57) ABSTRACT

A mobile zinc stripping device for stripping zinc from cathodes comprising a moveable base frame, a cathode support frame to support the cathodes during stripping, a stripping assembly for stripping the zinc sheets from the cathodes and at least one power source for powering the stripping assembly. The stripping assembly includes a lateral stripper for separating an upper edge of a zinc sheet from each of the cathodes, the lateral stripper being adapted to bias away from the cathode immediately upon entering between the zinc sheet and the cathode, and a scraping device for completing removal of the sheet from each said cathode. The device also includes a cathode cleaner and a bottom up stacker assembly for stacking zinc sheets.

33 Claims, 11 Drawing Sheets

FIG. 13
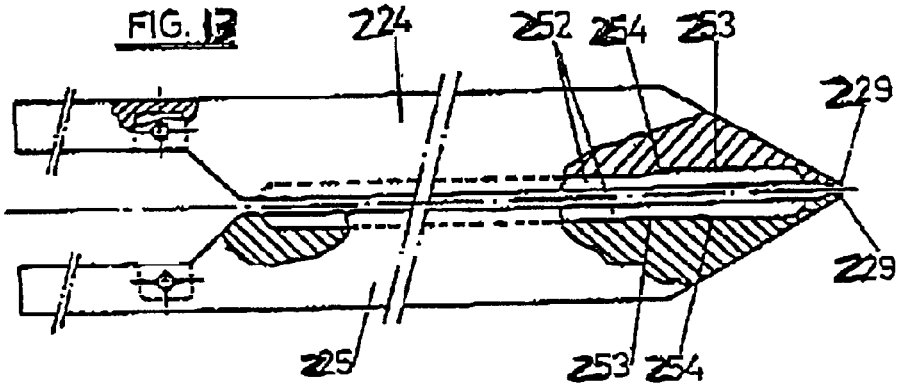
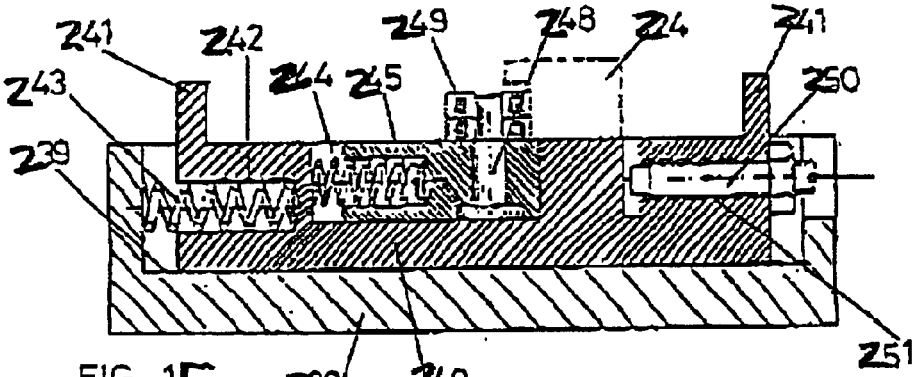
FIG. 15
FIG. 14
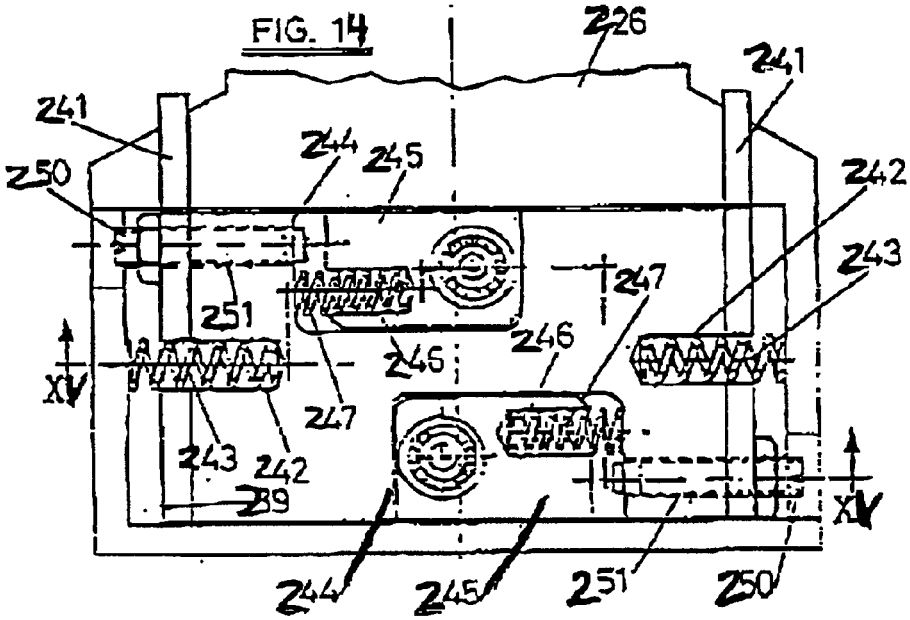

MOBILE ZINC CATHODE STRIPPING SYSTEM

FIELD OF THE INVENTION

This invention relates to the field of metal production and extraction, and in particular, to the extraction and production of zinc.

BACKGROUND OF THE INVENTION

Zinc is commonly refined by electrolysis. In a typical process, a number of plate cathodes are each inserted into a separate electrolytic cell. The electrolytic cell contains a chemical solution which includes zinc. An electric field is applied to the cell and zinc is deposited on the cathode up to the height at which the cathode is submerged in the electrolytic cell. The zinc forms a sheet or count on the cathode. The upper edge of the zinc sheet is located at the "solution line" of the cathode, the line below which the cathode was submerged in the zinc solution. In order to harvest the zinc which has been deposited on the cathodes, it is necessary to separate the zinc sheets from the cathodes.

This removal is typically done by a zinc sheet stripping machine. Typically, the cathodes are removed from the cells, and are taken to the zinc stripping machine, which strips the zinc sheets from the cathodes. The cathodes are then returned to the cells to undergo the electrolytic process again, while the removed zinc sheets are gathered and stored.

This zinc stripping machine will, over time, physically damage the cathode and render it unfit for continued use in the electrolytic process. Since the cathodes are capable of being used over and over in the electrolytic process, it is most economical if the cathodes have a longer life. The more frequently the cathodes need to be replaced, the higher the cost to the producer. Thus, erosion, scratching and other damage to cathodes is a continuing problem for zinc producers.

Also, the electrolytic process operates by the application of a current between pairs of cathodes and anodes in the electrolytic cells. It is the electrical potential between the cathodes and anodes that causes the zinc to deposit on the cathodes. Such electroplating is most efficient when the cathodes and anodes are clean and free of surface impurities. For example, dirt on the surface of the cathode can affect the electrical currents preventing the plating of the zinc on the cathode in the dirty areas. Thus, zinc producers also have the problem of needing to keep the cathodes clean in an efficient manner.

Another problem for zinc producers and their employees is the significant amount of noise that is created in the harvesting of zinc from the cathodes. The cathodes themselves, the zinc sheets being removed from them, and the machinery used to remove the zinc sheets are all metallic. Thus, when these things come in repeated contact with one another, a great deal of noise can be generated.

Some zinc extraction plants have fixed installations for removing the zinc from the cathodes. Such fixed installations are often used in larger plants, where the cost of a larger fixed installation is justified. Also, typically, fixed installations are appropriate where there is a significant amount of space available for the zinc extraction process. In a fixed installation, the cathodes are typically fed into the input end of the fixed stripping installation, and then are moved through various parts of the machine, during which time the zinc sheets are stripped and the cathodes are carried to the output end of the fixed installation.

There are cases, however, where it is uneconomical to have a fixed zinc sheet removal installation. There are also cases where the zinc producer is confronted with floor space so limited as to preclude the use of a fixed installation. In such cases, it is preferable to have a mobile zinc stripping system which can be moved between various different groups of electrolytic cells and used to strip the cathodes adjacent to such electrolytic cells.

Canadian Patent No. 2,178,776 discloses a mobile automated cathode stripping system. The system includes a support frame for supporting a plurality of cathodes hanging vertically in parallel alignment with one another. The system further includes a stripping mechanism including a carriage framework mounted for linear movement along the support frame. The stripping mechanism includes a single pivotable stripping arm assembly, The assembly provides a pair of stripping knives, one for each side of each cathode, which wedge underneath the zinc sheet at the top corner of the sheet. The knives then move in an arc along the cathode under the zinc sheet, thus stripping the zinc sheet from the cathode and allowing it to fall by gravity. The zinc sheets are then moved into a receiving bin, and when the bin is full, the stack is moved to another location to be picked up by a lift truck and carried away. Jet spray heads are provided on the carriage which carries the stripping arm assembly. The purpose of the jet spray heads is to spray water at the zinc sheets and at the aluminum cathodes after they have been stripped, in an attempt to clean them. The jet spray heads are suspended above the cathodes, and spray water downward at a 45° angle.

However, the system described in Canadian Patent No. 2,178,776 suffers from a number of defects. First, each side of the cathode is stripped by a single knife which traverses the entire vertical length of the cathodes. Such a stripping method erodes the aluminum cathodes unnecessarily, thus limiting their life.

Second, the water spray is not particularly effective, by itself, in cleaning the cathodes. This is particularly true in respect of any impurities which are stuck to the cathode. Such dirt may tend to stick despite the flow of water over them. Third, the device is awkward and difficult to use, because of the nature of the receiving bin for the stripped sheets.

U.S. Pat. No. 5,269,897 discloses an installation for removing the zinc deposited by electrolysis on aluminum plates. The installation includes a storage zone for coated cathodes, a scraping zone and a storage zone for zinc-free cathodes, with the cathodes being displaced consecutively from one zone to the next. The scraping zone includes a horizontally acting lateral piercer that separates the upper edge of the sheets of deposited zinc from the cathodes, and a vertically acting scraping device for removing all of the zinc sheets. The upper edge is separated by the lateral piercer being initially inserted under the zinc sheet. The heads of the piercer are then adjusted so that they no longer rest upon the cathode as the remainder of the upper edge is separated, thus reducing contact between the piercer and the cathode, and reducing damage to the cathode.

This patent, however, discloses a fixed installation where the cathodes are carried through the stripping device. Thus, the device disclosed in U.S. Pat. No. 5,269,897 is not appropriate for use where space is limited or where the cost of a fixed system is not justified.

SUMMARY OF THE INVENTION

Therefore, what is desired is a mobile zinc stripping machine that is effective in stripping zinc sheets from cathodes. The machine of the present invention will preferably operate so as to minimize damage to the cathodes during operation. It will also preferably be space efficient, be constructed so as to reduce the noise generated during the zinc stripping process, and be constructed so as to be able to effectively clean the cathodes after stripping.

Therefore, according to one aspect of the invention there is provided a device for stripping zinc sheets from cathodes, the device comprising:

a moveable base frame for moving the device along a floor;

a cathode support frame, coupled to the moveable base frame, the cathode support frame being sized, shaped and positioned to support the cathodes during stripping;

a stripping assembly for stripping the zinc sheets from the cathodes, the stripping assembly being movably coupled to the base frame and being moveable relative to the cathode support frame to permit the stripping assembly to strip each cathode supported in the cathode support frame;

at least one power source coupled to the base frame and operatively connected to the stripping assembly;

the stripping assembly including a lateral stripper, movable across the cathodes in the cathode support frame, for separating an upper edge of a zinc sheet from each of the cathodes, the lateral stripper being adapted to bias away from the cathode immediately upon entering between the zinc sheet and the cathode, and a scraping device, movable in a direction generally perpendicular to a direction of the lateral stripper, for completing removal of the sheet from each said cathode.

According to a further aspect of the invention, there is provided a device for stripping zinc sheets from cathodes, the device comprising:

a moveable base frame for moving the device along a floor;

a cathode support frame, coupled to the moveable base frame, the cathode support frame being sized, shaped and positioned to support the cathodes during stripping;

a stripping assembly for stripping the zinc sheets from the cathodes, the stripping assembly being movably coupled to the base frame and being moveable relative to the cathode support frame to permit the stripping assembly to strip each cathode supported in the cathode support frame;

a bottom-up stacker assembly coupled to the base frame;

a sheet carrier for transporting the zinc sheets to the stacker assembly, the sheet carrier being positioned so as to receive the zinc sheets when they are stripped, the stacker assembly being adapted to create a stack from the zinc sheets carried on the sheet carrier; and at least one power source coupled to the base frame and operatively connected to the stripping assembly, to the sheet carrier and to the stacker assembly.

According to a further aspect of the invention, there is provided a device for stripping zinc sheets from cathodes, the device comprising:

a moveable base frame for moving the device along a floor;

a cathode support frame coupled to the base frame, the cathode support frame being sized, shaped and positioned to support the cathodes during stripping;

a stripping assembly for stripping the zinc sheets from the cathodes, the stripping assembly being movably coupled to the base frame and being moveable relative to the cathode support frame to permit the stripping assembly to strip each cathode supported in the cathode support frame;

at least one cathode cleaner, movably coupled to the base frame, the cathode cleaner being movable along the cathode support frame and along each said cathode so as to permit the cathode cleaner to clean each cathode supported on the cathode support frame; and at least one power source coupled to the base frame and operatively connected to the stripping assembly.

BRIEF DESCRIPTION OF THE DRAWINGS

To facilitate a better understanding of the invention, a preferred embodiment will now be described with reference to the drawings in which:

FIG. 13 is a plan view of the arms of the lateral stripper;

FIG. 14 is a partial plan view of the lateral stripper table, in which the arms of the stripper have been removed; and FIG. 15 is a cross-section along the line XV—XV of FIG. 14.

DETAILED DESCRIPTION OF THE PREFERRED EMBODIMENT

Figure 1:
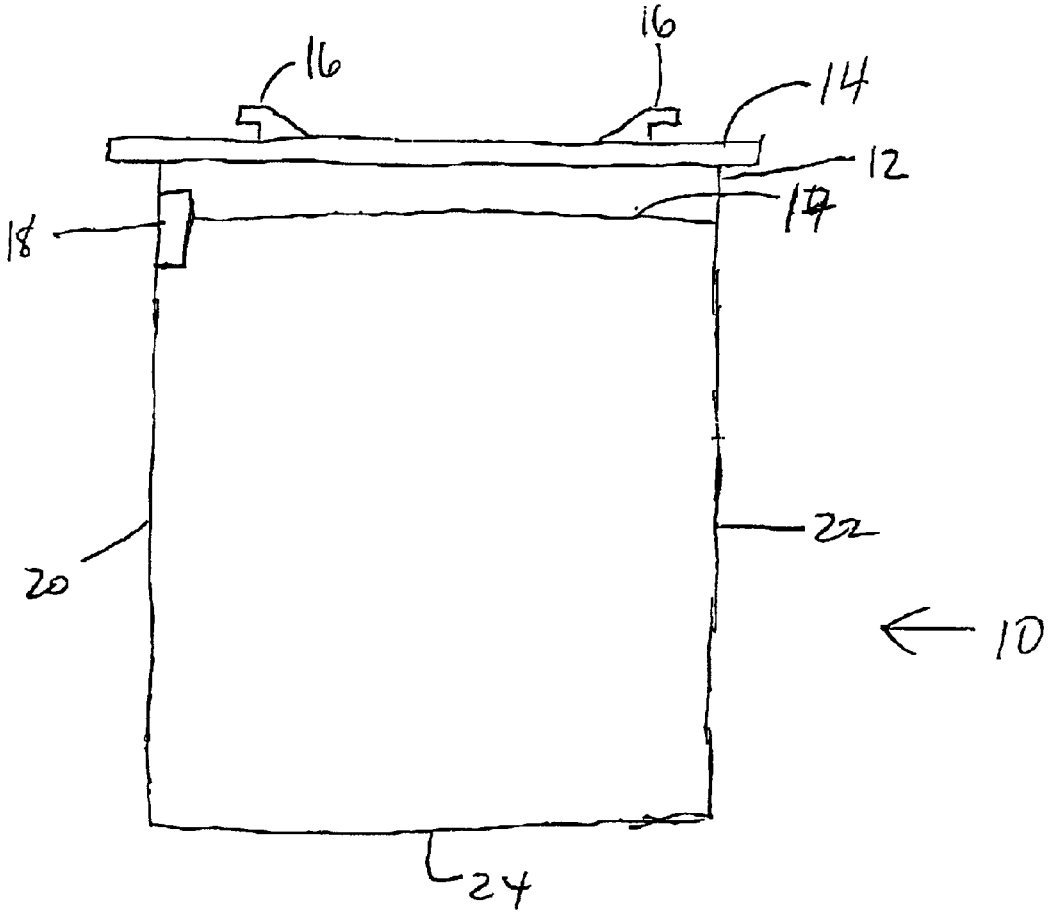
FIG. 1 is a side view of a typical cathode used in association with the present invention.

Referring now to FIG. 1, the preferred form of cathode for use in accordance with the present invention is shown. The cathode 10 includes an aluminum plate 12, a support bar 14, and carrying hooks 16. The aluminum plate 12 is preferably 50–60 inches long, 30–32 inches wide, and 0.25 inches thick. The plate 12 is immersed in an electrolytic cell and the zinc sheet 17 is created on both sides of the plate 12.

The cathode 10 also include a dielectric region 18. Because the dielectric is electrically neutral, no zinc adheres to the dielectric region 18. The plate 12 has side edges 20, 22, and a bottom edge 24. In the preferred form of cathode, the side edges 20, 22 are also coated with a dielectric, but the bottom edge 24 is not. Thus, zinc coats the bottom edge 24 during the electrolytic process, but not the side edges 20, 22. The result is a zinc sheet that has an overall V-shape. The zinc sheet 17 covers both flat sides of the plate 12 as well as the bottom edge 24, but not the side edges 20, 22.

Referring now to FIGS. 2–6, the first step in stripping the zinc sheets 17 from the cathodes 10 is to remove a number of the cathodes 10 from the electrolytic cell and place them in the cathode support frame 26. The cathode support frame 26 is sized, shaped and positioned to support the cathodes during stripping. In the preferred embodiment, the cathode support frame 26 comprises a continuous notched beam 28 on one side of the device, and, on the other, a series of spaced upright beams 30 having saddles or notches thereon. This configuration allows multiple cathodes 10 to be side loaded into the cathode support frame 26 through the spaces between the upright beams 30.

The notched beam 28 and the upright beams 30 are coupled to the base frame 31. The base frame 31 acts as the base for all of the components of the device described herein.

To load the cathodes 10 into the cathode support frame 26, a grabber (not shown) is used to lift the cathodes 10 out of an electrolytic cell. The grabber grasps the carrying hooks 16 of each cathode 10. Preferably, the cathodes 10 are loaded into the cathode support frame 26 in groups of fifteen.

The notches of the notched beam 28 and the upright beams 30 are sized and spaced such that one end of the support bar 14 sits securely in a notch of the notched beam 28, while the other ends sits securely in a notch of an upright beam 30. Each cathode 10 is thus held in place.

In the preferred embodiment, there are thirty cathode slots in the cathode support frame 26. When the cathodes 10 are loaded into the cathode support frame 26, they are preferably loaded into every second slot. If the cathode support frame 26 already contains cathodes 10 that have been stripped, then the new cathodes 10 which are about to be stripped can be loaded into the cathode support frame 26, and the stripped cathodes 10 can be removed immediately thereafter. Thus, loading the cathodes 10 into every second slot of the cathode support frame 26 allows for efficient use to be made of the machinery and labour used to load the cathodes 10 in and out of the cathode support frame 26. It will be appreciated by those skilled in the art that other configurations of the cathode support frame 26 are comprehended by the present invention. What is needed is to provide a cathode support frame 26 which is sized, shaped and positioned to suitably support cathodes during stripping.

Next, the cathodes 10 are stripped by the stripping assembly 32. The stripping assembly 32 includes a lateral stripper 34 and a vertical scraping device 36. The lateral stripper 34 is carried by a stripper carriage 38 and the scraping device 36 by a scraping device carriage 39. Both carriages 38 and 39 are movably mounted on two carriage rails 40 and 42 coupled to the base frame 31.

It will be appreciated that the carriages 38, 39 could ride on one carriage rail, or on more than two carriage rails. However, two carriage rails are preferred because such a configuration balances the need to provide adequate stability for the carriage 38 while not using up too much space.

It will be appreciated that the stripper 34 and scraping device 36 can be carried by any carriage assembly which allows them to move appropriately. However, the two carriage configuration (carriages 38, 39 as the carriage assembly) is preferred over, say, a single carriage, because it allows for a smaller device, given that the stripper 34 and scraping device 36 are separate (i.e. the scraping device trails the stripper).

The stripping assembly 32 operates as follows. The carriage 38 moves along the cathode support frame 26 to a position adjacent to each hanging cathode where the lateral stripper 34 and scraping device 36 strip each cathode 10 in turn. For each cathode 10, the first stage of stripping is performed by the lateral stripper 34.

The design of the lateral stripper 34 will be explained with reference to FIGS. 8 to 15.

Referring first to FIGS. 8 to 12, the lateral stripper consists of two equal horizontal arms, referenced with numbers 224 and 225, mounted with the ability to be longitudinally displaced along a table 226. These arms are connected to a rear actuating hydraulic cylinder 227 and their forward ends are wedge-shaped stripper heads 228 that define vertical tapered edges 229. The stripper 34 is located in a position facing one of the cathodes in the cathode support frame 26, in such a way that the arms 224 and 225 are located one on each side of a cathode 10. The stripper 34 is also situated at a height such that the tapered edges 229 of the arms 224 and 225 are at the height of the upper edge of the zinc sheets 17 stuck to the cathodes 10.

Figure 8:
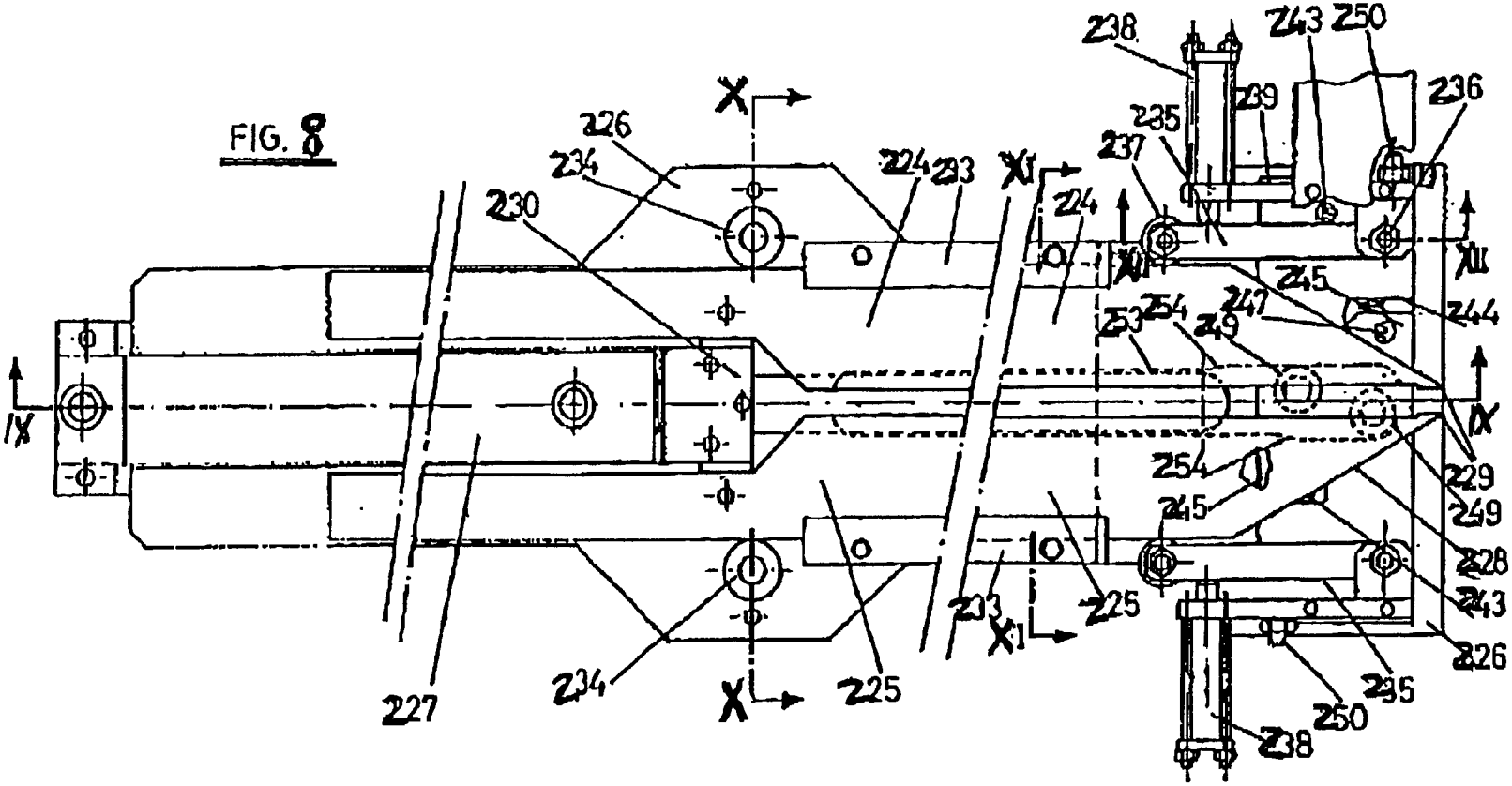
FIG. 8 is a plan view of the lateral stripper.
Figure 9:
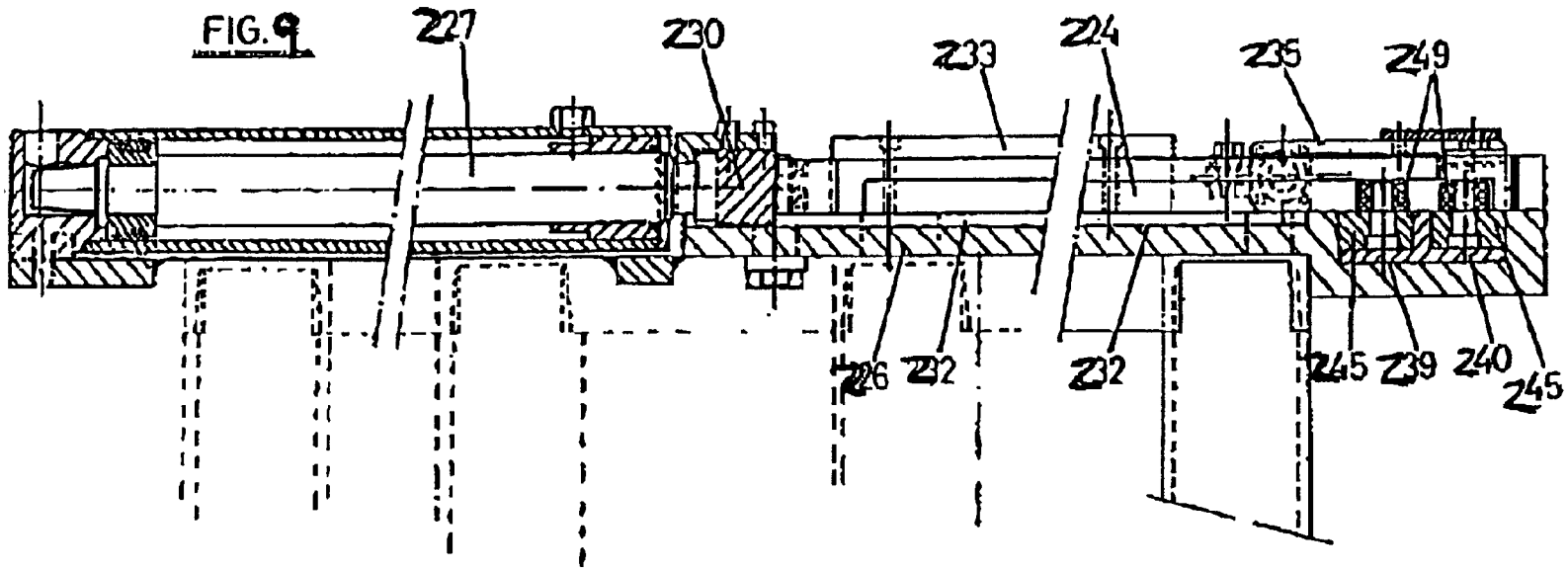
FIG. 9 is a longitudinal cross-section of the lateral stripper, taken along line IX—IX of FIG. 8.
Figure 10:
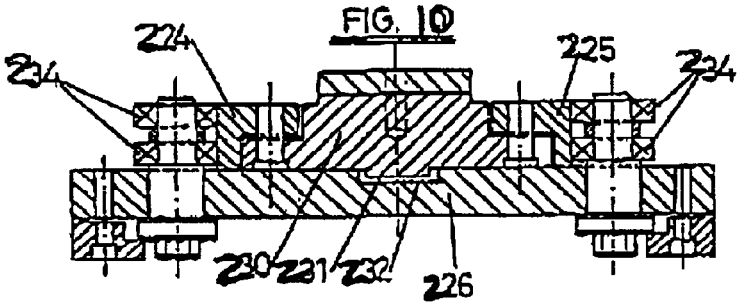
FIG. 10 is a transverse cross-section along the line X—X of FIG. 8.

As can be seen in FIGS. 8 to 10, the rod of the cylinder 227 is connected to a transverse head 230, the ends of which are connected to the arms 224 and 225. This head has a lower protuberance 231 that can be displaced along a longitudinal channel 232 formed in the table 226. In order to guide the longitudinal displacement of the arms 224 and 225, the table 226 also has fixed longitudinal guides 233 and freely rotating rear rollers 234.

Figure 12:
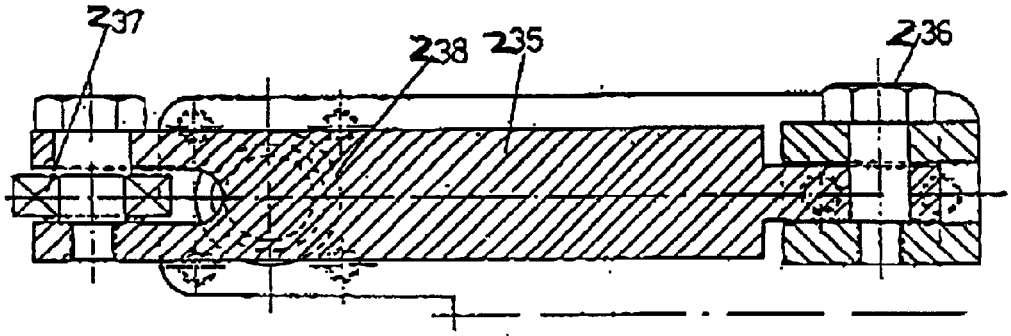
FIG. 12 is a cross-section along the line XII—XII of FIG. 8.

As can be seen in FIGS. 8, 9 and 12, mounted on the forward part of the table 226 are two lateral pushrods that drive the arms 224 against each other. Each of these pushrods consists of a rod 235 linked by one of its ends 236 to a fixed point, while the other end has a freely rotating roller 237 supported against the adjacent arm. Acting on the rod 235 is a cylinder 238, whose action causes the arms 224 and 225 to approach each other.

As can be seen in FIGS. 8, 9, 14 and 15, the table 226 forms an enlargement in its forward part in which, starting from its upper surface, an offset or slot 239 is created in which is mounted a support 240. This support 240 consists of a flat piece of width approximately equal to that of the slot 239 but with length slightly shorter, so that this piece is limited in its upper part by two transverse dividers 241 of length greater than the width of the support 240. Starting from the transverse sides, the support 240 has two facing blind drill-holes 242 which house compression springs 243 supported against the shorter walls of the slot 239. These serve as centralizing elements for the support 240.

The upper surface of the support 240 has two intermediate slots 244, each of which opens into one of the longitudinal sides of the support 240. These two intermediate slots 244 are slightly out of phase with each other in the longitudinal direction of the support 240. Each of these slots 244 has a centralizer 245. Each centralizer consists of a piece that is appreciably flat, with a rectangular contour and of width approximately equal to that of the slots 244 but with length shorter than these. Starting from a the side facing outwards, the centralizers 245 have a blind drill-hole what houses a compression spring 247 supported against the opposite wall of the slot 244. Between their larger surfaces, the centralizers 245 also have a drill-hole 248 for mounting a freely rotating roller 249 (FIGS. 10 and 11) for adjusting the separation of the arms 224 and 225, as will be explained below.

The position of the centralizing pieces 245 can also be adjusted by means of a threaded rod 250 that penetrates an opening 251 made in the transverse sides of the support 240 and which protrudes to the outside via a hole or opening made in the wall limiting the slot 239 in the table. Mounted on the ends of the dividers 241 of the support 240 are cylinders 238 that act on the rods 235 responsible for moving the arms together.

Figure 11:
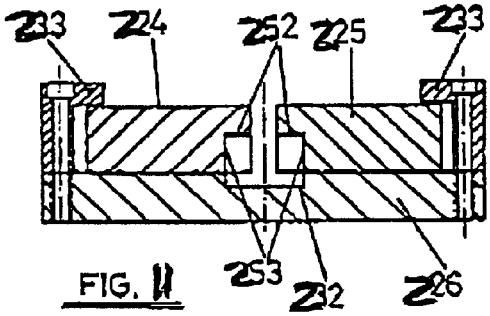
FIG. 11 is a transverse cross-section along the line XI—XI of FIG. 8.

As can be seen in FIGS. 11 and 13, the lower surface and adjacent sides of the arms 224 and 225 have offsets or recessed steps 252 that house the freely rotating rollers 249, defining the external vertical wall 253 of these offsets as rolling tracks for the rollers 249. The offsets 252 vary in width along a section 254, causing the edges 229 to become axially out of phase by a distance equal to the separation distance between the rollers 249. As can be seen in FIG. 8, the rollers 249 act on the track of the opposite arms.

In this configuration, for the arms 224 and 225 to act on the cathodes, and starting from the position shown in FIG. 8, the two arms begin to be displaced without the cylinders 238 being actuated until the sides 229 of the arms become located over the plate 12, one arm on each side, at the edge of that plate. At that moment, the cylinders 238 are actuated and the arms 224 and 225 move together in such a way that the edges 229 are supported on the surfaces of the cathode. The maximum distance of separation between the arms 224 and 225 is regulated by the threaded rods 250. Advancing in this position, the sides 229 of the arms start to scrape off the zinc sheets deposited on the cathode 10. During this advance, when the rollers 249 reach the ramps 254 of the tracks 253 on which these rollers are supported, the arms 224 and 225 are caused to separate slightly in such a way that the front sides 229 of the these arms no longer rest upon the surface of the cathodes 10. Thus, the rollers 249 act as moving or biasing elements to move or bias the heads 228 away from the cathode immediately after the edges 229 enter under the zinc sheet 229. From that moment on, the rapid advance of the arms 24 and 25 can be achieved, causing the zinc sheets 17 to be detached without scratching the surfaces of the cathodes. At a certain moment during the progress of the arms along the cathode, which can be regulated as wished, the action of the cylinders 238 can be cut out, with which the springs 247 push against the pieces 245, forcing the arms 224, 225 to become separated.

Because of the springs 243 and 247, the self-centring of the arms 224 and 225 over the cathodes is achieved, even when these blades start to deviate over the cathodes.

With the system of centring the arms 224 and 225 and moving them closer together, correct action is indeed achieved on the cathode for removing the upper part of the zinc deposits and preventing erosion or deterioration of the cathodes.

Once the upper edges 56, 58 of the zinc sheet 17 have been liberated from the plate 12, the lateral stripper 34 moves back to its original position and the carriage 38 moves along the cathode support frame 26 so as to permit the lateral stripper 34 to operate on subsequent cathodes 10. Meanwhile, the scraping device 36 is carried by the carriage 39 such that it trails the lateral stripper 34.

When the carriage 39 has moved into a position where the scraping device 36 is directly above a cathode 10 which has already been acted upon by the lateral stripper 34, the scraping device 36 then operates to completely remove the zinc sheet 17 from the cathode 10 as explained below.

Figure 7:
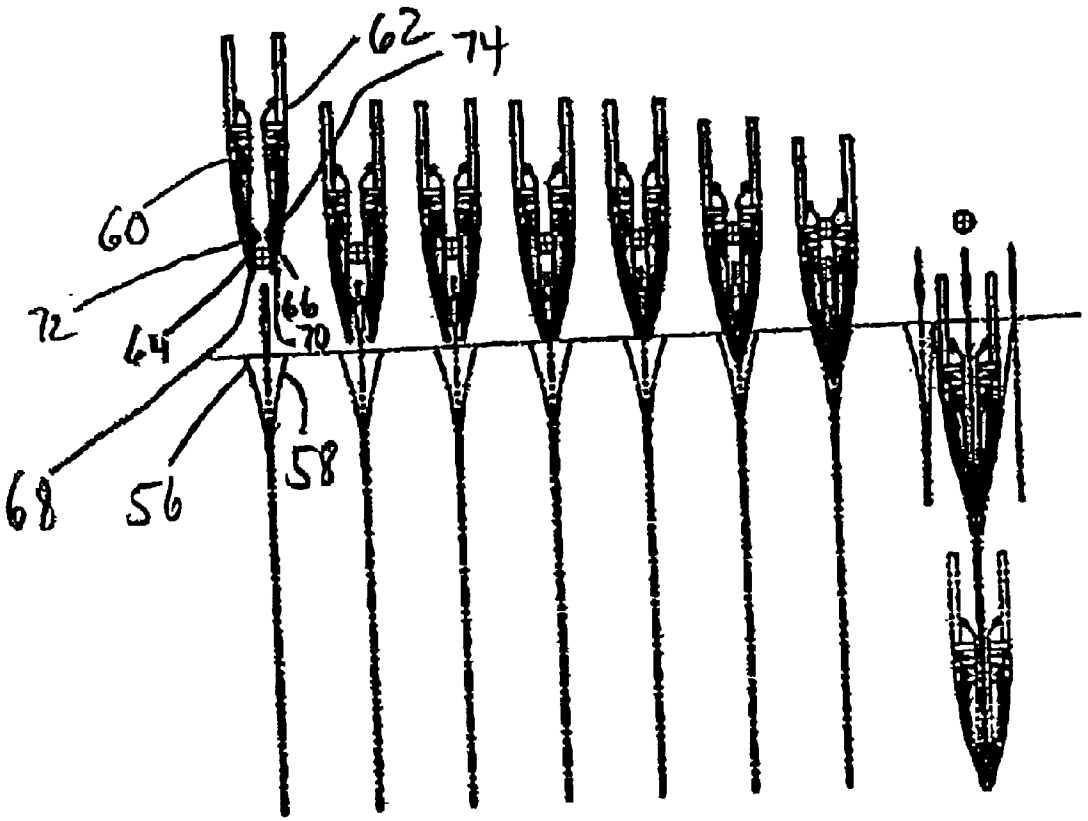
FIG. 7 shows the scraping device in operation.

This process is shown in detail in FIG. 7. The upper edges 56, 58 of the zinc sheet 17 have already been bent away from the plate 12 by the lateral stripper 34. The scraping device 36 then moves downwardly as shown into the wide gap so created.

The scraping device 36 includes two scraping arms 60, 62 and two scraping heads 64, 66, one for each side of the zinc sheet. As the scraping arms 60, 62 move downwardly, the tips of the scraping heads 64, 66 enter under the separated upper edges 56, 58 of the zinc sheet 17. As the scraping arms 60, 62 proceed still further downwardly, the scraping heads 64, 66 make contact with the inner portions of the zinc sheet 17 and force the zinc sheet 17 off the plate 12. The scraping arms 60, 62 are moved downwardly until the entire zinc sheet 17 has been stripped free from the plate 12.

The scraping heads 64, 66 are preferably positioned so that they do not rest against or even contact the plate 12 as they progress downwardly. This positioning significantly reduces the risk that the plate 12 will be physically damaged by scratching or scoring. This positioning is made possible by the fact that the upper edges 56, 58 have already been separated from the plate 12 by the lateral stripper 34 to form a wide gap. Thus, the scraping heads 64, 66 can engage and strip the zinc sheet 17 without the heads 64, 66 needing to contact the plate 12.

In the preferred embodiment, the scraping heads 64, 66 have rounded edges 68, 70 for contacting the zinc sheet 17 so as to minimize tearing or the like of the zinc sheet. Also, it is preferable to have, mounted to each of the scraping heads 64, 66, a stainless steel brush 72, 74 on the inside of the heads 64, 66. The stainless steel brushes 72, 74 are sized, shaped and positioned so as to brush the cathode as the scraping heads 64, 66 move downwardly and strip the zinc sheet 17. The brushes 72, 74 trail the edges 68, 70 of the heads 64, 66 as the zinc sheet 17 is stripped, and they brush the plate 12. When the scraping device 36 is raised again to prepare for stripping the next cathode 10, the brushes 72, 74 again brush the plate 12. The brushes 72, 74 are preferably positioned such that each one of brushes 72, 74 brushes one side of the plate 12.

It is preferable also that the scraping heads 64, 66 extend along the entire width of the plate 12. This has two benefits. First, stripping can be completed most efficiently if the force is exerted evenly across the zinc sheet 17, which reduces the likelihood that the sheet will tear or buckle. Second, the brushes 72, 74 mounted on the inside of the heads 64, 66 can extend completely across the plate 12, thus providing a more thorough cleaning of the plate 12. It will further be appreciated that the wedging force to strip the zinc sheet 17 provides a seating force for the brushes, causing good cleaning contact.

It will be appreciated by those skilled in the art that, though the stripping assembly described above is preferred for the reasons given, other stripping assemblies may be used within the present invention. What is important is that the device includes a stripping assembly 32 movably coupled to the base frame 31, which is effective in stripping the zinc sheets 17 from the cathodes 10. The stripping assembly 32 should be movable relative to the floor 76 on which the device sits, and relative to the cathode support frame 26 so as to permit the stripping assembly to strip the cathodes 10 when they are on the cathode support frame 26.

After the zinc sheets 17 are stripped from the cathodes 10, they drop to the sheet carrier 78, which is positioned so as to receive the zinc sheet 17 when they are stripped. The sheet carrier 78 preferably comprises a conveyor belt 80 operatively coupled to a pair of drive shafts 82, which shafts drive the conveyor belt 80 by rotating.

Figure 2:
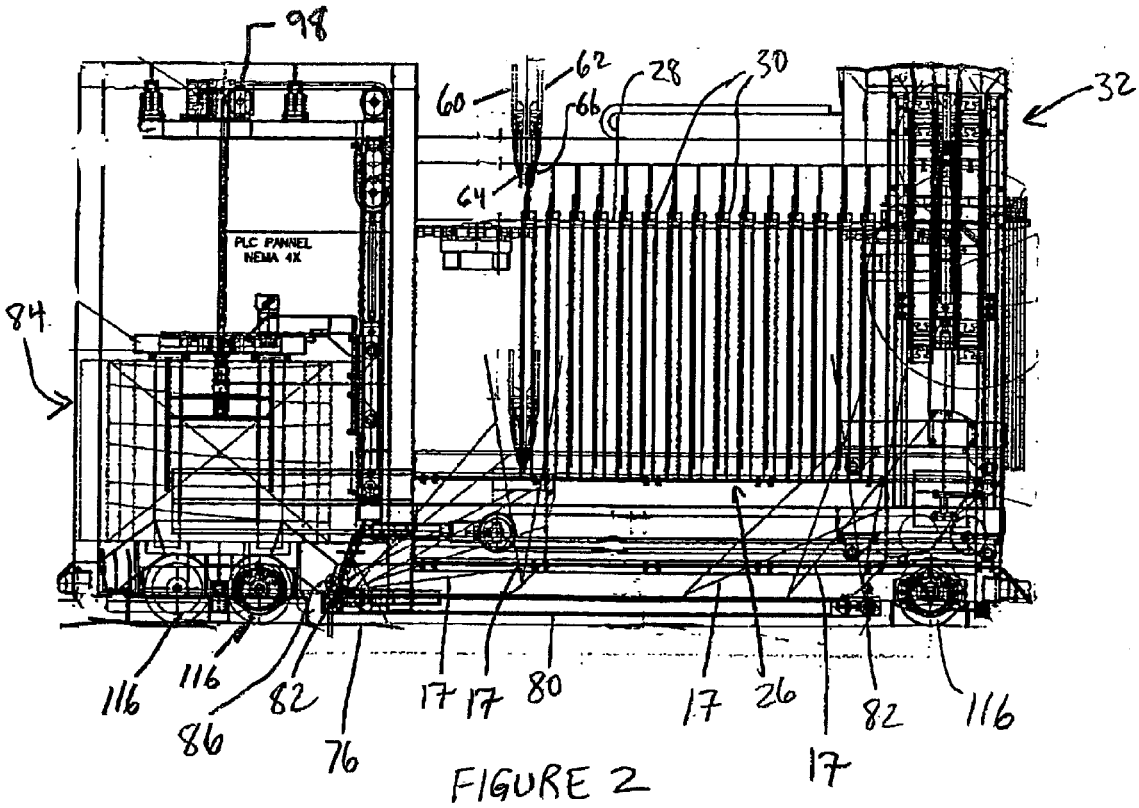
FIG. 2 is a side view of the preferred embodiment of the mobile zinc stripping device.
Figure 3:
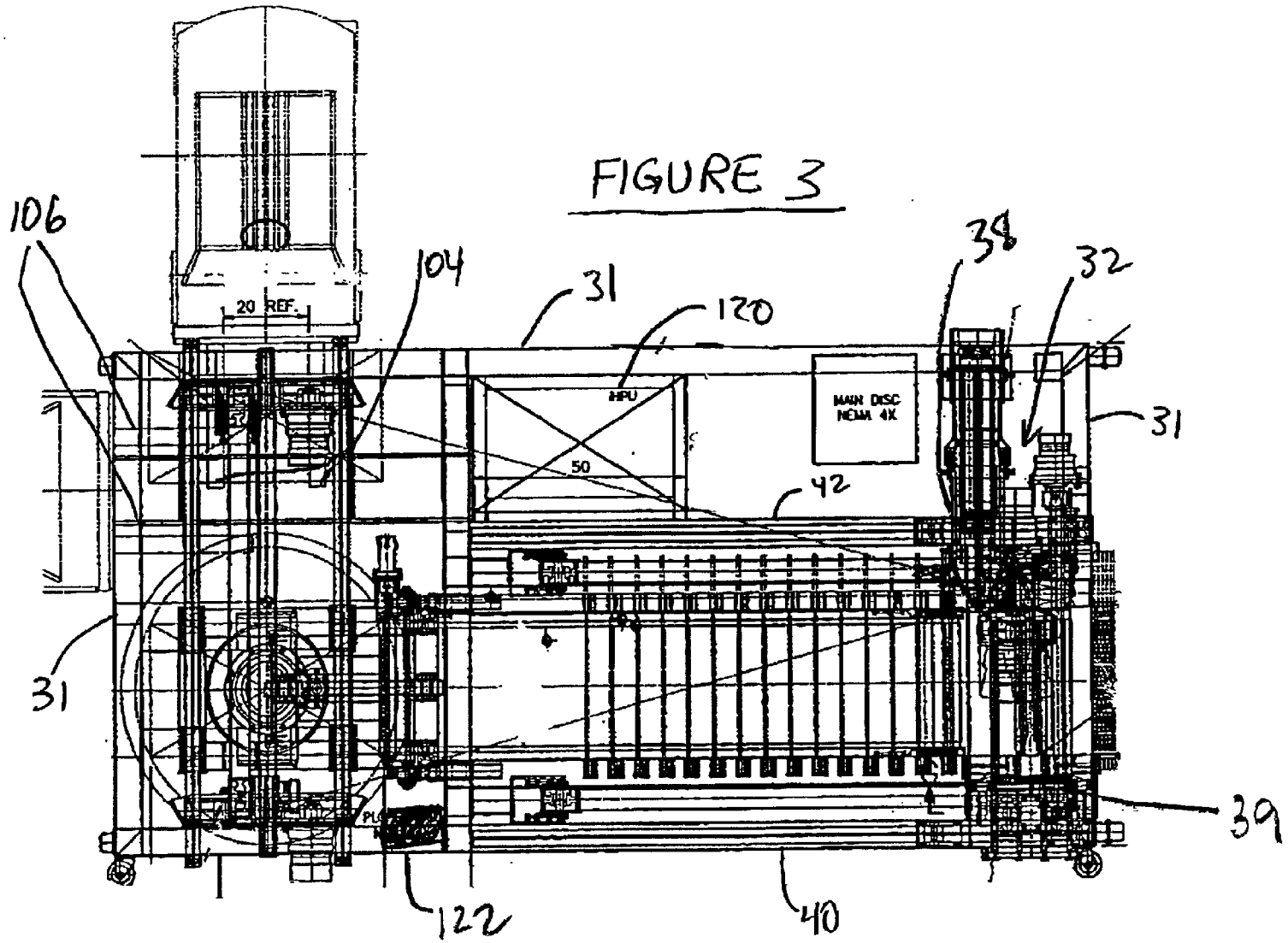
FIG. 3 is a plan view of the preferred embodiment of the mobile zinc stripping device.
Figure 4:
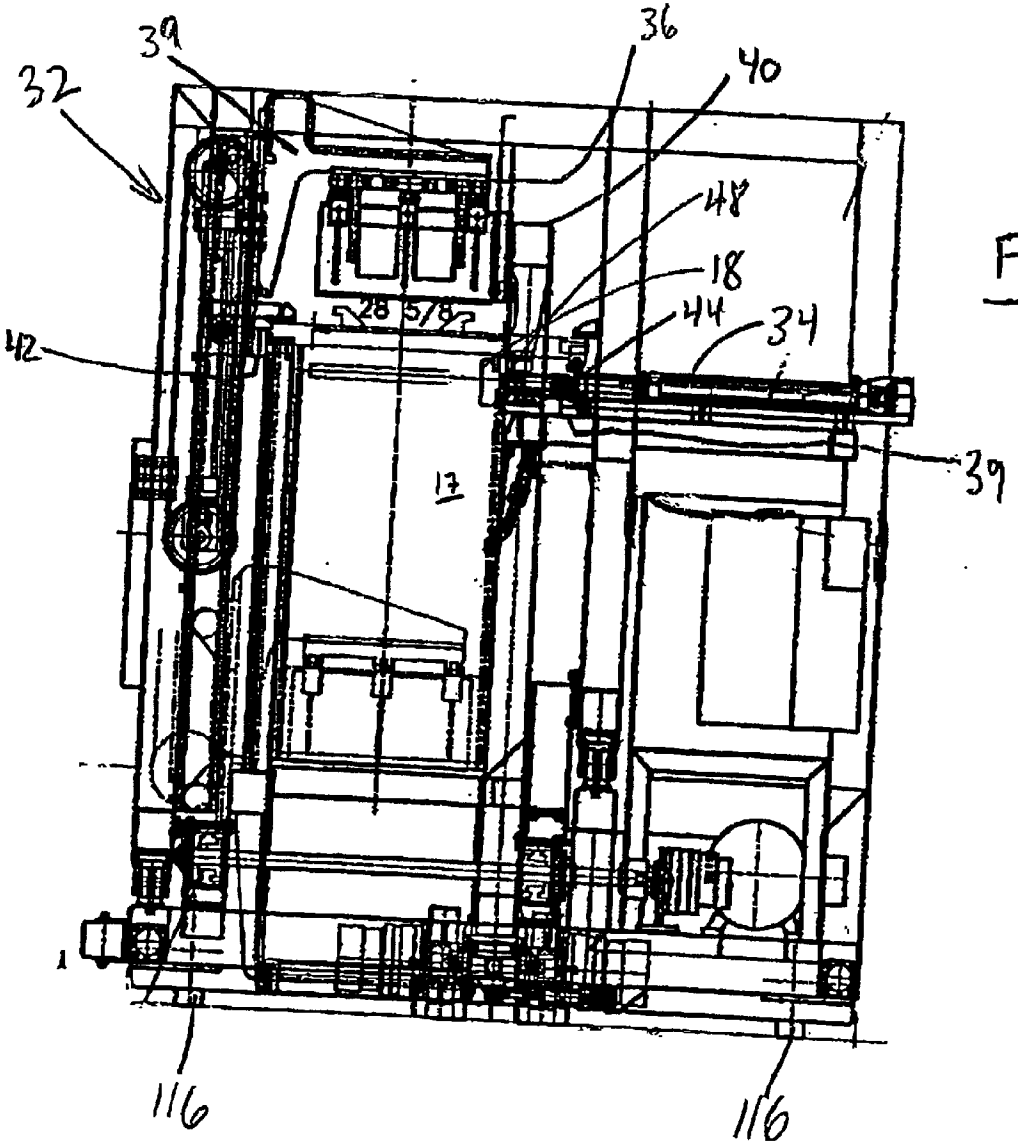
FIG. 4 is an end view of the preferred embodiment of the mobile zinc stripping device from the cathode support frame end.
Figure 5:
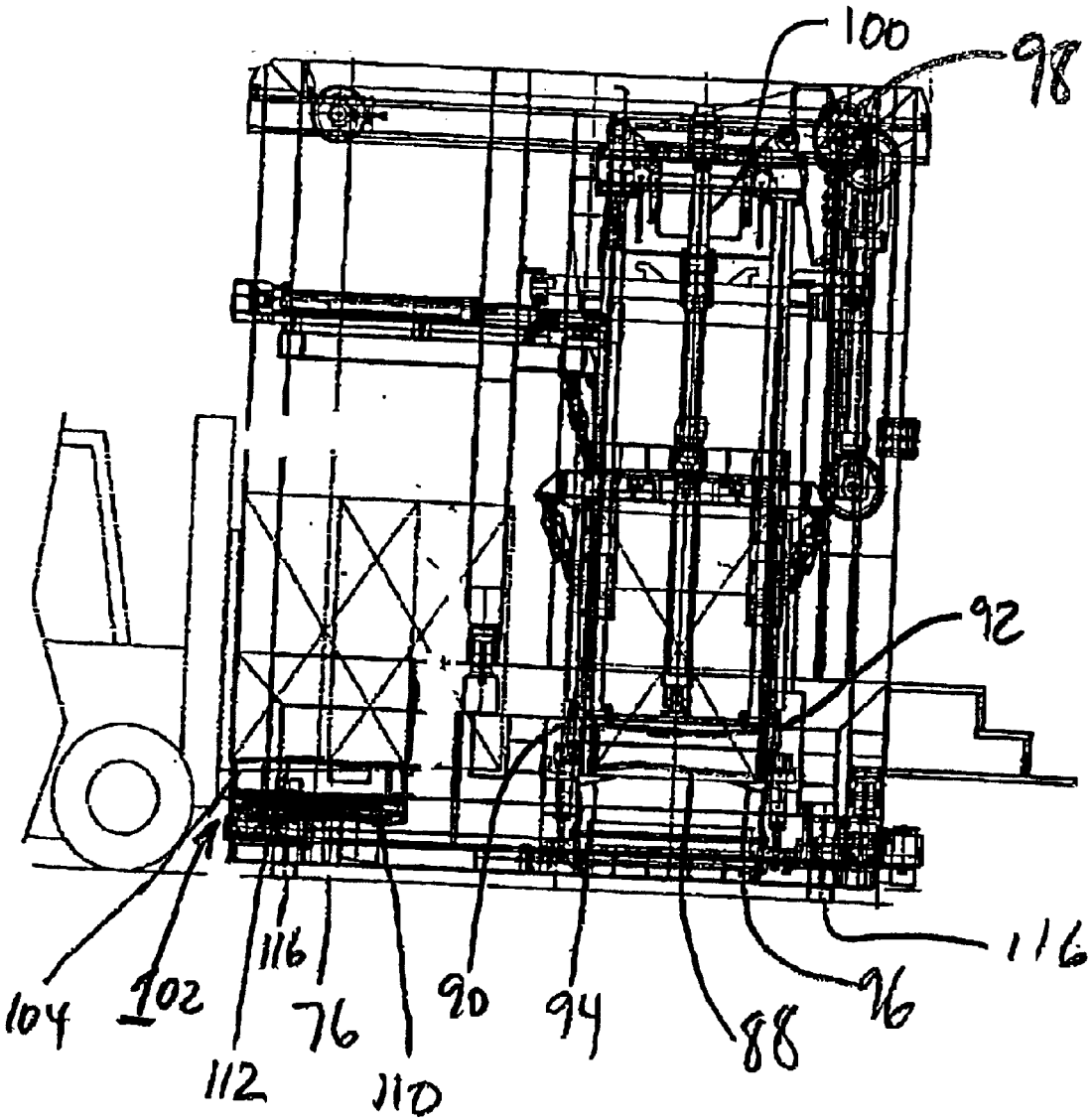
FIG. 5 is an end view of the preferred embodiment of the mobile zinc stripping device from the stacker assembly end.
Figure 6:
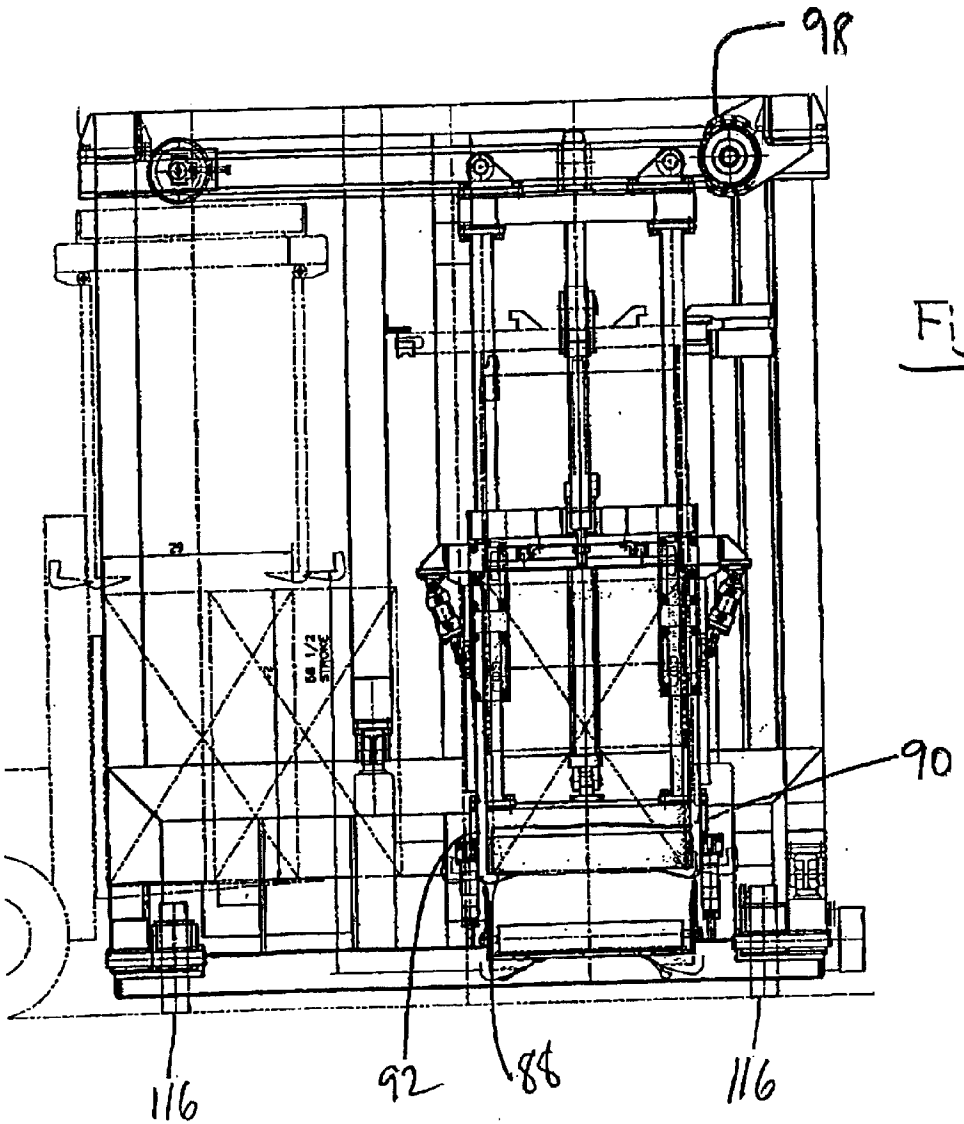
FIG. 6 is a rear view of the stacker assembly with details of the device removed for clarity.

As shown in FIG. 2, preferably the zinc sheets 17 which have been stripped have a "V" or "taco" shape. As the sheets 17 contact the conveyor belt 80, the sheets 17 are typically tipped sideways by the motion of the conveyor belt 80 and carried toward the stacker assembly 84, which stacker assembly is coupled to the base frame 31.

As the conveyor belt 80 carries the sheets 17 to the stacker assembly 84, the sheets 17 are preferably flattened and prepared for stacking by passing under the pinch roller 86. The pinch roller 86 is coupled to the base frame 31 and positioned at the end of the conveyor belt 80, and just above the conveyor belt 80. The pinch roller 86 allows the zinc sheets 17 to proceed to the stacker assembly 84, but at the same time, flattens the zinc sheets 17 (i.e. closes the "V" of the V-shaped zinc sheets) as they are carried to the stacker assembly 84 by the conveyor belt 80.

It will be appreciated that, though this structure for the sheet carrier 78 is preferred, it is not required for the present invention. Rather, any sheet carrier 78 for transporting the zinc sheets 17 to the stacker assembly 84 will suffice if the sheet carrier 78 is positioned so as to receive the zinc sheets 17 when they are stripped.

The stacker assembly 84 is preferably a bottom-up stacker assembly, i.e., adapted to create a stack 88 by a bottom-up stacking method. This method is preferred because it allows for a saving of floor space, thus allowing the device to have a smaller footprint. In top down stacking, the zinc sheets 17 would need to be carried up to the top of the stack. This would necessitate the greater use of floor space, as the conveyor belt 80 would need to extend further in order to carry the sheets diagonally upwardly to the top of the stack. By contrast, with bottom-up stacking, it is only necessary to carry the zinc sheets 17 to the bottom of the stack 88, thus shortening the required length of the conveyor belt 80 and rendering smaller the overall footprint of the stripping device.

In the preferred embodiment, the stacking assembly comprises a stack grasper in the form of a pair of arms 90, 92 having hook portions 94, 96 for grasping the stack 88 from below. The stacking assembly also preferably comprises a lifting mechanism 98 coupled to the base frame 31 and the arms 90, 92.

To perform bottom up stacking, the arms 90, 92 grasp the stack 88 which is lifted by the lifting mechanism 98. An additional zinc sheet 17 is then carried to the stacker assembly 84 by the conveyor belt 80, and the stack 88 is then placed upon the additional zinc sheet 17 by the lifting mechanism 98 being lowered, the arms 90, 92 opening to release the stack 88 onto the additional zinc sheet 17, and the arms 90, 92 closing again under the additional zinc sheet 17. The additional zinc sheet 17 is thus added to the stack 88.

It will be appreciated that this method of stacking is likely less noisy than a top-down stacking method, because, in a top-down stacker, the additional sheet will often fall onto the existing stack in a noisy manner. By contrast, in the preferred embodiment, the stack is placed (not dropped) on the additional zinc sheet, and then the stack, including the recently added sheet, is picked up again.

Also, the arms 90, 92 are preferably rotatably coupled to the base frame 31, most preferably through a rotatable stacker shaft 100. The rotatable stacker shaft 100, together with the arms 90, 92, act as a stack rotator which can rotate the stack up to approximately 180° C. about the vertical stacking axis in a plane generally parallel to the floor 76. In the preferred embodiment, the rotatable stacker shaft 100 is coupled to the base frame 31 at a point above the stack 88, such that when the shaft 100 rotates, the stack 88 is rotated in a plane generally parallel to the floor 76.

Typically, the stack 88 will tend to become of uneven height across its width as more sheets 17 are added to the stack 88. In particular, the side of the stack 88 where the closed ends of the sheets 17 are located will be at a different height than the side where the open ends are, as more sheets 17 are added. One reason for this is that, during the electrolytic process, the zinc tends to flow slightly toward the bottom of the cathode 10. Thus, as sheets 17 are added to the stack 88, it may become progressively more lopsided and unstable. However, by rotating the stack 88 when it is half complete, the stack 88 can be balanced and rendered more stable. For this reason, it is preferably that the device include a stack rotator, and most preferably that it include the stack rotator described above.

The device also preferably includes a stack removal station 102 coupled to the base frame. In the preferred embodiment, the arms 90, 92 are movable along the base frame 31 to and from the stack removal station 102 so that the arms 90, 92 can move a completed stack 88 to the stack removal station 102.

The stack 88 is placed on the stack removal station 102 to allow the stack 88 to be removed in order to make space for the next stack. In the preferred embodiment, the stack removal station has a first lift truck access and a second lift truck access. Most preferably, the first lift and second lift truck accesses comprise first and second pairs of hollows 104, 106 for receiving the forks of a lift truck. Having two lift truck accesses provides increased flexibility of loading in the event floor space is limited. Thus, in a tight space, there may be no room for a lift truck to approach the first lift truck access. However, providing a second lift truck access creates another route by which the lift truck can reach the stack 88 to be removed. Most preferably, the two pairs of hollows 104, 106 are positioned at approximately right angles to one another, so that the lift truck can access the stack 88 either from the end of the device or the side of the device.

The stacks 88 will typically, because of the shape of the sheets 17, have a wider and a narrower dimension when seen in plan view. For greater stability, the lift truck will preferably lift the stack 88 with its wider dimension across the forks and its narrower dimension parallel to them. Thus, in the preferred embodiment, the arms 90, 92 are adapted to rotate the stack between a first position to facilitate use of the first pair of hollows 104, and a second position to facilitate the use of the second pair of hollows 106, where the second position is angularly displaced from the first position. Most preferably, the first and second positions will be angularly displaced from one another by about 90°.

In the preferred embodiment, the device further includes a scale 110 operatively coupled to the stack removal station 102 for sensing the weight of a stack 88. Most preferably, the stack removal station includes a platform 112, and the scale is positioned below the platform 112 such that the gravitational force operating on the stack 88 is transmitted to the scale 110.

Having the scale 110 is useful for quality control purposes, so that the zinc producer can tell what the variation is in the weight of the stacks 88, and for inventory control purposes, so that the producer can know how much zinc it is producing, and how much it has in inventory. Thus, it is most preferably if the scale 110 is connected to the producer's inventory and quality control computer databases so as to efficiently provide the producer with the required information.

In order to make the stripping device mobile, the movable base frame 31 preferably includes a set of wheels 116 coupled to the base frame and positioned so as to support the base frame on the floor. Most preferably, at least two of the wheels 116 are connectable to a mobility power source, such as a hydraulic or electrical power source, for moving the device.

Most preferably, the device operates automatically and is controlled by at least one controller or more, if necessary or desirable. The controller is preferably a Programmable Logic Controller 122 of the type generally available for operating industrial machinery.

Also, preferably, the moving portions of the device are powered by at least one power source (which includes multiple power sources). Most preferably, the power source is a hydraulic pump 120 which is operatively connected to and thus powers the stripping assembly, stacking assembly, sheet carrier and stack rotator. The hydraulic pump 120 may also be used to power the wheels 116.

While the foregoing embodiments of the present invention have been set forth in considerable detail for the purposes of making complete disclosure of the invention, it will be apparent to those skilled in the art that various modifications can be made to the device without departing from the scope of the invention as defined in the attached claims. Some of these variations are discussed above and others will be apparent to those skilled in the art. For example, the power source may be a source other than a hydraulic pump, such as, for example, an electric motor. What is considered important in the present invention is to provide a mobile zinc stripping device which, preferably: is floor-space-efficient, reduces the wear on the cathodes being stripped, and provides a means for effectively cleaning the cathodes.

The embodiments of the invention in which an exclusive property or privilege is claimed are defined as follows:

1. A device for stripping zinc sheets from cathodes, the device comprising:

a moveable base frame for moving the device along a floor;

a cathode support frame, coupled to the moveable base frame, the cathode support frame being sized, shaped and positioned to support the cathodes during stripping;

a stripping assembly for stripping the zinc sheets from the cathodes, the stripping assembly being movably coupled to the base frame and being moveable along the cathode to permit the stripping assembly to strip each cathode supported in tire cathode support frame;

at least one power source coupled to the base frame and operatively connected to the stripping assembly;

the stripping assembly including a lateral stripper, movable across the cathodes in the cathode support frame, for separating an upper edge of a zinc sheet from each of the cathodes, the lateral stripper being adapted to bias away from the cathode immediately upon entering between the zinc sheet and the cathode, and a scraping device, movable in a direction generally perpendicular to a direction of the lateral stripper, for completing removal of the sheet from each said cathode.

2. The device of claim 1, the moveable base frame including a set of wheels, the wheels being positioned on the base frame so as in support the base frame on the floor.

3. The device of claim 2, the set of wheels including at least two wheels which ire connectable to a mobility power source for powering the at least two wheels.

4. The device of claim 1, the lateral stripper including a first stripper head corresponding to a first side of the cathode and a second stripper head corresponding to a second side of the cathode, the first stripper head being carried on a first stripper arm, the second stripper head being carried on a second stripper arm, the stripper including biasing elements positioned to bias the first and second stripper heads away from the cathode immediately upon the first and second stripper heads entering between the sheet and the cathode.

5. The device of claim 1, the stripping assembly further including a carriage assembly carrying the lateral stripper and the scraping device, the carriage assembly being movably coupled to the base frame, the carriage assembly being movable relative to the cathode support frame and relative to the floor so as to permit the lateral stripper and the scraping device to strip the cathodes when the cathodes are on the cathode support frame.

6. The device of claim 5, the stripping assembly further including at least one carriage rail coupled to the base frame and extending along the cathode support frame, the at least one carriage rail carrying the carnage assembly.

7. The device of claim 1 further comprising a bottom-up stacker assembly coupled to the base frame and a sheet carrier for transporting the zinc sheets to the bottom-up stacker assembly, the sheet carrier being positioned so as to receive the zinc sheets after they are stripped, the bottom-up stacker assembly being adapted to create a stack of the zinc sheets carried on tire sheet carrier, the at least one power source being operatively connected to the bottom-up stacker assembly and the sheet carrier.

8. The device of claim 7, bottom-up the stacker assembly including a stack grasper comprising a pair of arms for grasping the stack, and a lifting mechanism, coupled to the base frame and to the pair of arms, for lifting the stack and placing it on the additional zinc sheet.

9. The device of claim 7, further comprising a stack removal station, the bottom-Up stacker assembly including a stack grasper coupled to the base frame so us to be horizontally movable along the base frame, the stack removal station being positioned such that the stack grasper can move the stack from the bottom-Up stacker assembly to the stack removal station, the device further including a scale, operatively coupled to the stack removal station, for sensing a weight of the slack.

10. The device of claim 9, the stack removal station comprising a platform, the scale being positioned below the platinum such that the force of the stack on the platform is transmitted to the scale.

11. The device of claim 1 further comprising a stacker assembly coupled to the base frame and a sheet carrier for transporting the zinc sheets to the stacker assembly, the sheet carrier being positioned so as to receive the zinc sheets after they are stripped, the stacker assembly being adapted to create a stack of the zinc sheets carried on the sheet carrier, the stacker assembly including a stack rotator for rotating the stack in a plane generally parallel to the floor, the at least one power source being operatively connected to the stacker assembly, the sheet carrier and the stack rotator.

12. The device of claim 11, the stack rotator being adapted to rotate the stack approximately 180° about a vertical stacking axis.

13. The device of claim 12, the stack rotator including a stack grasper rotatably coupled to the base frame and positioned so as to be able to grasp the stack and rotate it in a plane generally parallel to the floor.

14. The device of claim 13, stack grasper comprising a pair of arms, each of the arms having a hook position for grasping the stack.

15. The device of claim 1, further comprising a stacker assembly coupled to the base frame and a sheet carrier for transporting the zinc sheets to the stacker assembly, the sheet carrier being positioned so as to receive the zinc sheets after they are stripped, the stacker assembly being adapted to create a stack of the zinc sheets carried on the sheet carrier, the device further comprising a stack removal station, the stacker assembly including a stack grasper coupled to the base frame so as to be horizontally movable along the base frame, the stack removal station being positioned such that the stack grasper can move the stack from the stacker assembly to the stack removal station, the stack removal station including a first lift truck access and a second lift truck access.

16. The device of claim 15, the stack grasper being rotatably coupled to the base frame, such that the suck may be placed at the stack removal station in a first position to facilitate use of the first lift truck access, and such that the stack may be placed in a second position, angularly displaced from the first position, to facilitate use of the second lift truck access.

17. The device of claim 16, the first and second lift truck accesses each comprising a pair of hollows in said stack removal station for receiving the forks of a forked lift truck.

18. The device of claim 17, the first lift truck access and the second lift truck access being positioned generally at right angles to each other.

19. A device for snipping zinc sheets from cathodes, the device comprising:

a moveable base frame for moving the device along a floor;

a cathode support frame, coupled to the moveable base frame, the cathode support frame being sized, shaped and positioned to support the cathodes during stripping;

a stripping assembly for stripping the zinc sheets from the cathodes, the snipping assembly being movably coupled to the base frame and being moveable relative to the cathode support frame to permit the stripping assembly to strip each cathode supported in the cathode support frame;

a bottom-up stacker assembly coupled to the base frame;

a sheet carrier for transporting the zinc sheets to the stacker assembly, the sheet carrier being positioned so as to receive the zinc sheets when they are stripped, the stacker assembly being adapted to create a stack from the zinc sheets carried on the sheet carrier and at least one power source coupled to the base frame and operatively connected to the stripping assembly, to the sheet carrier mud to the stacker assembly.

20. The device of claim 19, the bottom-up stacker assembly including a stack grasper and a lifting mechanism, the lifting mechanism being coupled to the base frame and the stack grasper, the lifting mechanism being adapted to lift the stack and place it on an additional zinc sheet transported to the bottom-up stacker assembly.

21. The device of claim 20, the stack grasper comprising a pair of arms, the arms each having a book portion for grasping the stack.

22. The device of claim 19, the stripping assembly including a lateral stripper, movable across the cathodes in the cathode support frame, for separating an upper edge of a zinc sheet from each of the cathodes, the lateral stripper being adapted to bias away from the cathode immediately upon entering between the zinc sheet and the cathode, and a scraping device, movable in a direction generally perpendicular to a direction of the lateral piercer, for completing removal of the sheet from each said cathode.

23. The device of claim 22, the bottom-up stripping assembly farther including a carriage assembly carrying the lateral stripper and the scraping device, the carnage assembly being movably coupled to the base frame, the carriage assembly being movable relative to the cathode support frame and relative to the floor so as to permit the lateral stripper and the scraping device to strip each cathode supported on the cathode support frame.

24. The device of claim 19, further comprising a stack removal station, the bottom-up stacker assembly including a stack grasper coupled to the base frame, the stack grasper being movable along the base frame in a direction generally parallel to the floor, the stack removal station being positioned such that the stack grasper can move the stack from the bottom-up stacker assembly, the stack removal station having a first lift truck access and a second lift truck access.

25. The device of claim 24, the stack grasper being rotatably coupled to the base frame, such that the stack may be placed at the stack removal station in a first position to facilitate use of the first lift truck access, and such that the stack may be placed in a second position, angularly displaced from the first position, to facilitate use of the second lift truck access.

26. The device of claim 25, the first and second lift truck accesses each comprising a pair of hollows in amid stack removal station for receiving the forks of a forked lift truck.

27. The device of claim 26, the first lift truck access and the second lift truck access being positioned generally at right angles to each other.

28. The device of claim 19, further comprising a stack removal station, the bottom-up stacker assembly including a stack grasper coupled to the base frame, the stack grasper being movable along the base frame in a direction generally parallel to the floor, the stack removal station being positioned such that the stack grasper can move the stack from the stacker assembly, the device further comprising a scale, operatively connected to the stack removal station, for sensing a weight of the stack.

29. The device of claim 28, the stack removal station comprising a platform, the scale being positioned below the platform such that the force of the stack on the platform is transmitted to the scale.

30. A device for stripping zinc sheets from cathodes, the device comprising:

a moveable base frame for moving the device along a floor;

a cathode support frame coupled to the base frump, the cathode support frame being sized, shaped and positioned to support the cathodes during stripping;

a stripping assembly for snipping the zinc sheets from to cathodes, the stripping assembly being movably coupled to the base frame and being movable relative to the cathode support frame to permit the stripping assembly to strip each cathode supported in the cathode support frame;

at least one cathode cleaning brush, movably coupled to the base frame, the cathode cleaning brush being movable along the cathode support free and along each said cathode so as to permit the cathode cleaning brush to brush each cathode supported on the cathode support frame; and at least one power source coupled to the base frame and operatively connected to the stripping assembly.

31. The device of claim 30, the stripping assembly including a lateral stripper, movable across the cathodes in did cathode support frame for separating an upper edge of a zinc sheet from each of the cathodes the lateral stripper being adapted to bias away from the cathode immediately upon entering between the zinc sheet and the cathode, and a scraping device, movable in a direction generally perpendicular to a direction of the lateral stripper, for completing removal of the sheet from each said cathode, the at least one brush being a coupled to the scraping device, the at least one brush being positioned so as to clean each said cathode as each said zinc sheet is stripped therefrom.

32. The device of claim 31, the at lest one brush comprising a first brush and a second brush, the first brush being coupled to the scraping device and positioned so as to clean one side of each said cathode, and the second brush being coupled to the scraping device and positioned so us to clean an opposite side of each said cathode.

33. The device of claim 32, the scraping device including a first scraping head corresponding to a first side of the cathode and a second scraping head corresponding to a second side of the cathode, the cathode cleaner comprising a first brush mounted to the first scraping head and a second brush mounted to the second scraping head.

* * * * *